United States Patent [19]

Cyr et al.

[11] 4,150,777

[45] Apr. 24, 1979

[54] CONTAINER

[75] Inventors: Steven J. Cyr; John C. Schubert, both of Chippewa Falls, Wis.

[73] Assignee: Standard Oil Company (Indiana), Chicago, Ill.

[21] Appl. No.: 902,340

[22] Filed: May 3, 1978

Related U.S. Application Data

[63] Continuation of Ser. No. 826,719, Aug. 22, 1977, abandoned.

[51] Int. Cl.[2] ..... B65D 1/24; B65D 43/10

[52] U.S. Cl. ..... 229/2.5 R; 220/306; 220/367

[58] Field of Search ..... 229/2.5, 44, 45; 220/307, 306, 367

[56] References Cited

U.S. PATENT DOCUMENTS

| | | | |
|---|---|---|---|
| 2,884,155 | 4/1959 | Hansom | 229/2.5 R X |
| 3,633,785 | 1/1972 | Cyr et al. | 229/2.5 R X |
| 3,767,110 | 10/1973 | Congleton | 229/45 |
| 3,851,789 | 12/1974 | Case et al. | 220/307 |
| 3,876,130 | 4/1975 | Haase | 229/2.5 R |
| 3,935,962 | 2/1976 | Schubert et al. | 220/306 |
| 3,955,710 | 5/1976 | Commisso | 220/306 X |
| 3,968,921 | 7/1976 | Jewell | 229/2.5 R |
| 4,079,880 | 3/1978 | Edwards | 220/306 |
| 4,096,986 | 6/1978 | Florian | 229/2.5 R X |

*Primary Examiner*—Davis T. Moorhead

*Attorney, Agent, or Firm*—Robert R. Cochran; Arthur G. Gilkes; William T. McClain

[57] ABSTRACT

Container suitable for use in fast food operations which permits longer storage of food products therein while maintaining good quality. Projections are provided on the base of the container to permit air circulation between a prepared food product and prevent deterioration thereof.

5 Claims, 8 Drawing Figures

FIG. 1
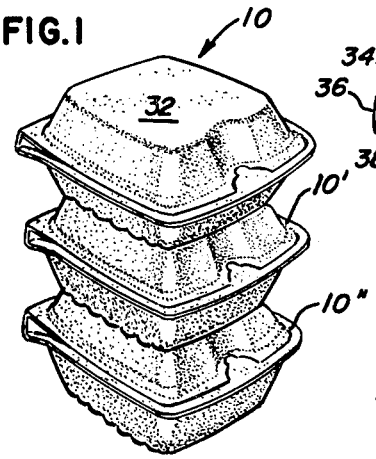
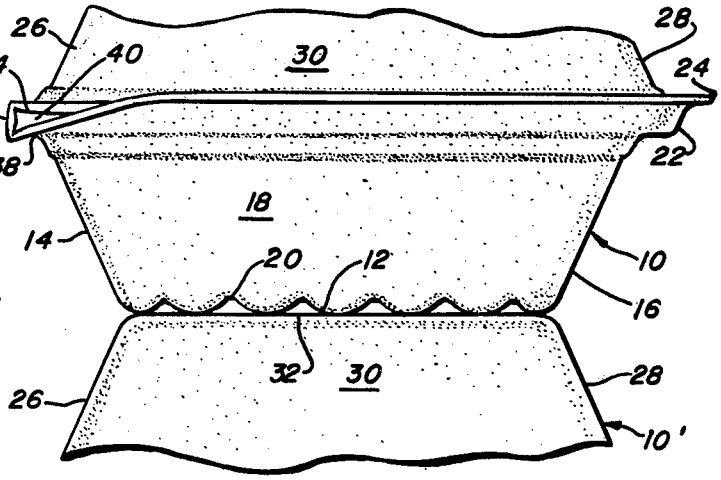
FIG. 2
FIG. 3
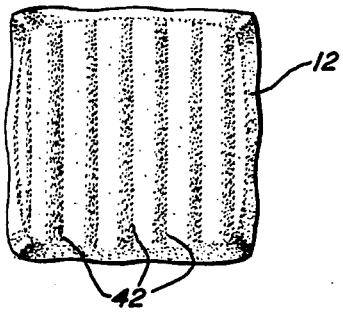
FIG. 4
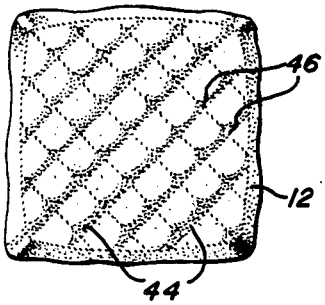
FIG. 5
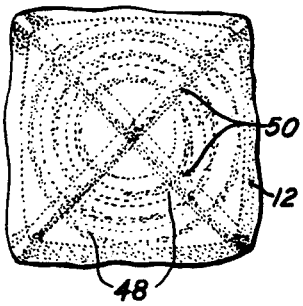
FIG. 6
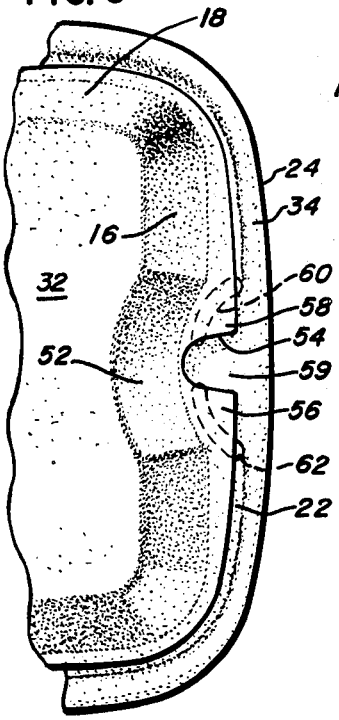
FIG. 7
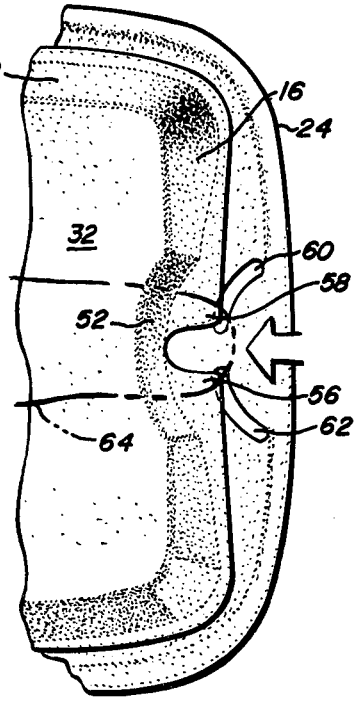
FIG. 8
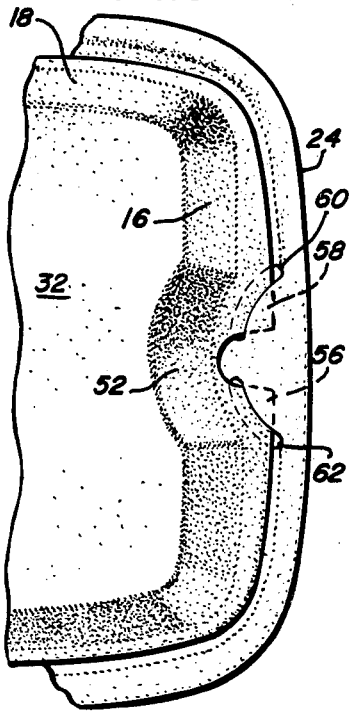

CONTAINER

This is a continuation of Ser. No. 826719 filed Aug. 22, 1977 now abandoned.

FIELD OF THE INVENTION

Deformable plastic containers made of foamed polystyrene and other materials are widely used in the food service field where containers are filled, stored, and supplied to the consumer at a later time. For the hot sandwich use, these are generally made in one piece having a common hinged border and a snap-in closure opposite said hinge.

DESCRIPTION OF THE PRIOR ART

Schubert et al. 3,935,962 (1976) discloses hot food containers similar to the container disclosed herein and said patent is incorporated herein by reference, attention being particularly drawn to the container shown in FIG. 6 of said patent.

SUMMARY OF THE INVENTION

The object of our invention is to provide a new and useful container having a particularly shaped bottom which permits air circulation between the bottom and a food product, such as a hamburger, contained therein, in combination with an improved latch for such a container.

Broadly, our invention resides in a deformable container comprising top and base members with outwardly sloping sidewalls hingedly attached along one wall and provided with latch means adapted to maintain said container closed wherein projections are provided on the base which support an article in said container, the projections permitting gas flow between an article in the container and the base. The latch means disclosed provides a secure closure, but one which is easily closed and opened. The latch includes a generally U-shaped cutout or notch on the lip providing two tabs extending outwardly from the top portion of the container which engage two slots in the sidewall of the lower portion. The slots are provided in the downwardly extending portion of a projection which extends inwardly from the tip of the lower portion and downwardly to the sloping sidewall. Due to the flexible nature of the container, pressure on the top or lid of the container permits deforming of the lid inwardly to permit insertion of and removal of the tabs from the slots.

BRIEF DESCRIPTION OF THE DRAWING

FIG. 1 illustrates three containers stacked one upon the other.

FIG. 2 shows a fragmentary side view of one container stacked upon another.

FIGS. 3, 4 and 5 show various bottom configurations.

FIGS. 6, 7 and 8 are fragmentary top views of the front portion of the container in the process of being closed, FIG. 6 before closure, and FIG. 8 showing the locked position.

DETAILED DESCRIPTION OF THE PREFERRED EMBODIMENTS

FIG. 1 illustrates three of the containers with the closure locked stacked one upon another, these being 10, 10' and 10''.

FIG. 2, a fragmentary side view of two of the stacked containers, illustrates one modification of the invention in greater detail. The top container 10 is shown resting upon the lower container 10'. Each container is provided with a lower portion having a base 12, upwardly sloping rear wall 14, front wall 16, and sidewalls 18. The bottomwall 12 is provided with a series of projections 20 adapted to maintain a food article positioned above the general level of the base 12 and to permit air circulation between said food article and said base. This also permits air circulation between containers. Near the upper portion of the bottom ofthe container there is provided an outwardly and upwardly shelf area 22 which terminates in lip 24. This shelf extends completely across the front almost completely along the sides. The top of container 10', shown in FIG. 2, contains a rear wall 26, front wall 28 and sidewalls 30. As shown in FIG. 1, the top 32 of the container is flat. Near the bottom of the top 30, there is an outwardly projecting lip 34 which rests in the shelf 22 of the bottom portion of the container. At the junction of the top portion and the bottom portion of the container, a hinge 36 is provided. The lip 24 on the bottom portion of the container extends downwardly to connect with hinge portion 36 as shown at 38, this resulting in a steam outlet space 40 between the top and bottom portions.

FIG. 3 shows a bottom plan view of the base 12 of container 10 illustrating a preferred embodiment of this invention. In this modification, a series of grooves 42 are provided extending across the bottom 12 of the container. Modifications are shown in FIGS. 4 and 5, FIG. 4 shows grooves 44 and 46 running diagonally between the sides of the container. FIG. 5 shows concentric circular grooves 48 and diagonal grooves 50 extending between corners of the bottom of the container. These projections permit circulation of air between the food product and the bottom, these configurations permit escape of steam present and reduce steam condensation in the food product.

FIGS. 6, 7 and 8 illustrate the features of the latch of our invention and show the container in the unlatched, in the process of being latched, and latched condition, respectively. Reference numerals similar to those set forth above are used in these figures. FIG. 6 illustrates the structure of front wall 16 which is provided with an inwardly protruded surface 52. The front portion of lip 34 on top of the container is provided with a generally U-shaped cutout or notch 54 located in line with the inwardly protruded surface 52. As a result of this construction, tab portions 52 and 58 are formed. The front lip 24 on the bottom portion of the container has a shoulder 59 which extends inwardly from the lip 24 toward the hinge and downwardly to the shoulder portion 22. Two slots 60 and 62 are provided in the downwardly sloping wall of the projection 59 which are aligned with tabs 56 and 58. The wall portion between the slots strengthens shoulder 59.

In the process of closing the container, as shown in FIG. 7, the thumb or finger 64 of the operator is shown deforming the top front side wall so that tabs 56 and 58 are retracted sufficiently to drop into slots 60 and 62. The arrow indicates the direction of movement.

After depressing the top portion to its fully closed position such that lip 34 on the top portion contacts the shelf 22 on the lower portion, the pressure against inwardly protruding surface is removed and the tabs 56 and 58 extend into the slots 60 and 62 thereby extending under the lip 24 of the lower portion.

This results in a firmly locked package but one which is easily opened by the customer by pressing on the inwardly protruding surface 52 thereby unlatching the tabs from the slots. This constitutes an improvement over prior art locking systems which involve more complicated fastening systems or the use of longer slots which tend to weaken the article, and prevent a secure latch. The vertical portion of the member 59 in large measure produces this improvement and strengthens this portion of the container.

The improved structure disclosed herein is suitable for use within any container, but we believe it will find its greatest use in the insulated food package such as a hamburger container. Such products are made by thermoforming a foamed polystyrene sheet, but other plastic materials can be used.

While we have described preferred embodiments of our invention, it will be obvious to those skilled in the art that additional modifications can be made while coming within the broad scope of our invention. For instance, latch means of the type described can be substituted for the hinge to produce a container latched on two sides as in FIG. 7 of Schubert et al. 3,935,962 supra.

We claim:

1. In a deformable container comprising top and base members, said base member having outwardly and upwardly sloping front side and rear walls and said top member having outwardly and downwardly sloping front side and rear walls, latch means adapted to form a secure closure between said top and base members, each said latch means comprising a lip on the outer end of a wall on one of said members, a shoulder having a downwardly extending sidewall projecting inwardly from said lip on said wall, two slots extending through the sidewall of said shoulder, and two tabs on the other of said members adapted to interlock with said slots and projection on said base adapted to support an article in said container so as to permit gas flow between an article in said container and said base.

2. A container especially adapted as a carry-out package for a hot sandwich comprising a base, front side and rear walls sloping upwardly and outwardly from said base, said front wall terminating in an outwardly extending lip, a cover having a top generally parallel to said base and front side and rear walls sloping downwardly and outwardly from said top, said front wall terminating in an outwardly extending lip, a hinge connecting said rear walls, a latch adapted to form a secure closure between said front walls, the first part of said latch comprising a shoulder having a downwardly extending sidewall projecting inwardly from the lip on the front wall extending from said base, two slots extending through the sidewall of said shoulder, and tabs on the lip of said top adapted to interlock with said slots and projections on said base adapted to support an article in said container so as to permit gas flow between an article in said container and said base.

3. The container of claim 2 wherein said projections comprise a series of ridges extending between opposite walls of the container parallel to the hinge.

4. The container of claim 2 wherein said projections comprise a plurality of interconnecting ridges extending diagonally of said base.

5. The container of claim 2 wherein said projections comprise a plurality of concentric circular ridges with intersecting ridges extending between edges of the container.

* * * * *

UNITED STATES PATENT OFFICE
CERTIFICATE OF CORRECTION

Patent No. 4,150,777 Dated April 24, 1979

Inventor(s) Cyr-Schubert

It is certified that error appears in the above-identified patent and that said Letters Patent are hereby corrected as shown below:

Column 2, Line 47, "portions 52 and 58" should be "portions 56 and 58"

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*